United States Patent [19]

McKamey et al.

[11] Patent Number: 4,888,842

[45] Date of Patent: Dec. 26, 1989

[54] SWIMMING POOL CLEANING MECHANISM

[76] Inventors: Porter L. McKamey, 7524 Pinewood Dr., Chattanooga, Tenn. 37421; Phillip M. Maeder, 6921 Sandy Cove Dr., Harrison, Tenn. 37341

[21] Appl. No.: 271,720

[22] Filed: Nov. 16, 1988

[51] Int. Cl.[4] ..... E04H 3/20

[52] U.S. Cl. ..... 15/1.7; 43/14; 210/407; 210/470

[58] Field of Search ..... 15/1.7; 43/11, 14; 210/407, 470

[56] References Cited

U.S. PATENT DOCUMENTS

| | | | |
|---|---|---|---|
| 2,203,827 | 6/1940 | Kors | 43/14 |
| 2,553,980 | 5/1951 | Ostrander | 43/14 |
| 3,188,668 | 6/1965 | Buckelew | 15/1.7 |
| 4,152,801 | 5/1979 | Lieber | 15/1.7 |
| 4,518,495 | 5/1985 | Harding . | |
| 4,557,001 | 12/1985 | Burkhart . | |

*Primary Examiner*—Edward L. Roberts

[57] ABSTRACT

A mechanism for removing debris from the floor surface of a swimming pool. Two long pole assemblies are extended downwardly into the swimming pool to support a transversely-extending strainer screen. The pole assemblies are moved along the length of the pool to enable the strainer screen to capture particulates on or near the floor surface of the pool.

14 Claims, 1 Drawing Sheet

SWIMMING POOL CLEANING MECHANISM

BACKGROUND OF THE INVENTION

This invention relates to mechanism for removing particulates, especially leaves, from swimming pools. The mechanism is especially designed to remove particulates from the floor surfaces of swimming pools.

Prior to our invention others have suggested the use of small bag-like strainer screens attached to long poles, as devices for removing debris from swimming pools. Typically, the pool owner stands on the pool deck and dips the strainer screen into the pool water; the long pole is manipulated to draw the bag-like screen along the water surface or along the pool floor surface so as to capture leaves or other particulates in the path of the strainer screen mouth.

The conventional strainer screens are relatively small devices, such that many passes of the screen are necessary to cover a complete swimming pool. Considerable time is required to accomplish a complete pool debris-removal operation. Often the pool owner ceases his efforts after only a few passes of the strainer screen, thereby leaving the pool in partially cleaned condition.

U.S. Pat. No. 4,518,495 to H. Harding and U.S. Pat. No. 4,557,001 to S. Burkhart show strainer screen devices for removing debris from an entire pool (or at least a large portion of the pool) in a single sweep, or pass. However, these patented devices are intended to operate only on the water surface; they are not intended for use along the pool floor surface.

SUMMARY OF THE INVENTION

My invention contemplates a strainer screen mechanism that can be drawn along the floor surface of a swimming pool to remove leaves or other particulates located on or slightly above the floor surface.

My improved mechanism can be operated (moved) by person standing on the pool deck without excessive effort. The mechanism is viewed as a time-saving alternative to the small skimmer nets attached to poles, as previously described.

THE DRAWINGS

DESCRIPTION OF A PREFERRED EMBODIMENT OF THE INVENTION

Figure 1:
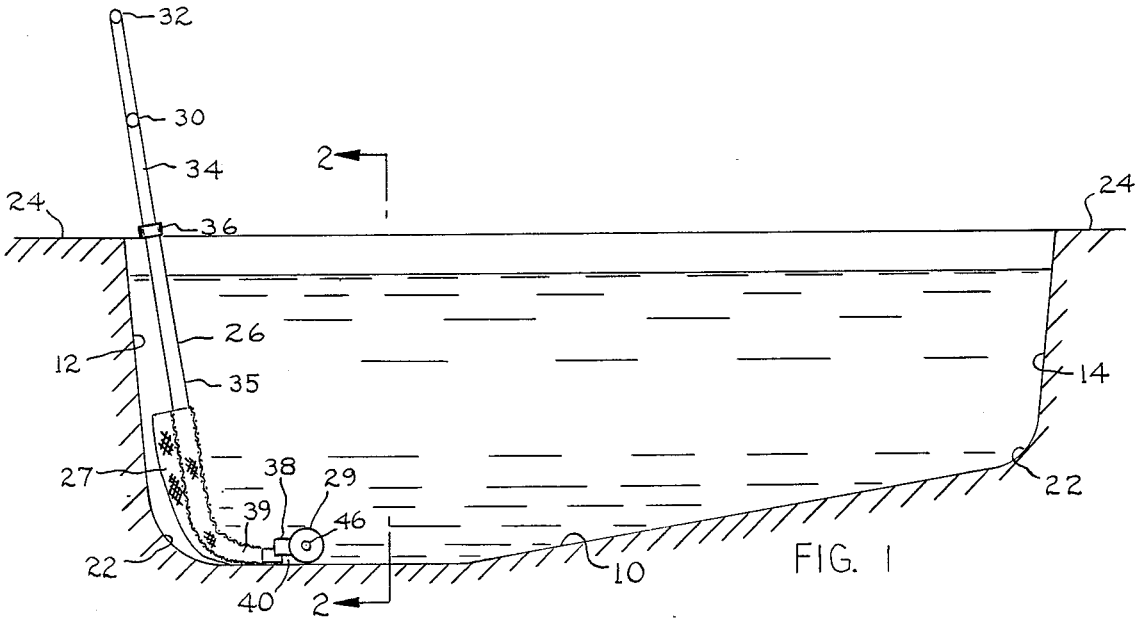
FIG. 1 is a pictorial illustration (not necessarily to scale) of a swimming pool, showing an apparatus of my invention positioned for movement in a left-to-right direction to remove debris from the pool floor surface.

The drawings show a swimming pool that includes a floor surface 10, upstanding left end wall 12, upstanding right end wall 14, and two upstanding side walls 16 and 18. The junctures between floor surface 10 and the various upstanding walls 12, 14, 16 and 18 are curved, as shown at 22. The area around the swimming pool defines a horizontal deck surface 24.

The drawings are intended to show a generally conventional swimming pool. My invention relates to a mechanism for removing leaves and other particulates from floor surface 10 of the pool; the mechanism can also be used for removing debris from the water surface, but its primary purpose is to remove particulates from floor surface 10.

Figure 2:
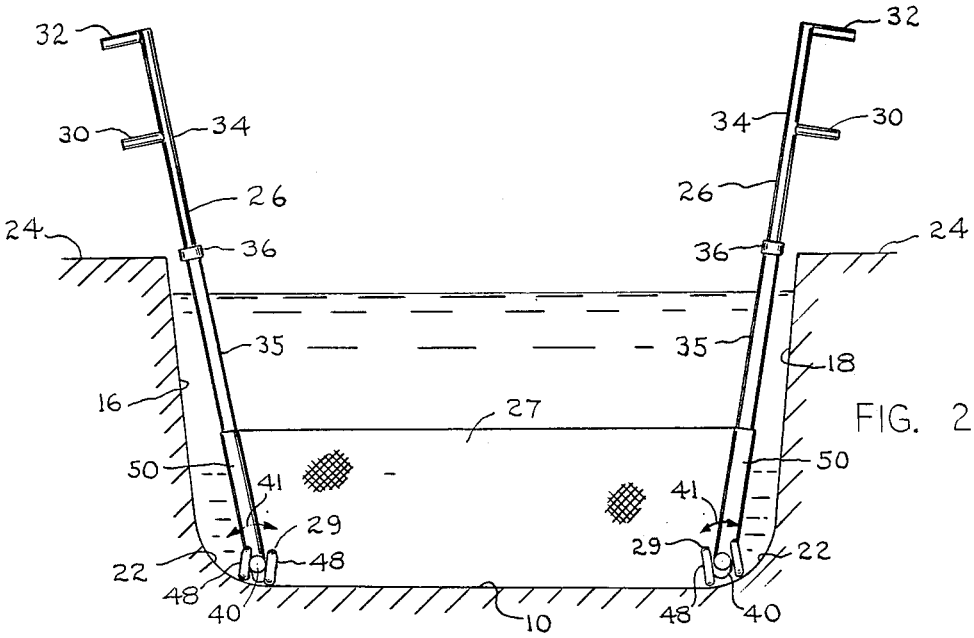
FIG. 2 is a view taken on line 2—2 in FIG. 1.

The illustrated mechanism comprises two laterally-spaced pole assemblies 26 adapted to assume upright positions in the swimming pool, as shown in FIGS. 1 and 2. A cloth strainer screen (or net) 27 extends between the two pole assemblies. Also, each pole assembly has a roller assembly 29 attached to its lower end for rolling engagement with the pool floor surface 10. Each pole assembly 26 is of sufficient length that when the roller assemblies are engaged with the pool floor surface the upper ends of the pole assemblies are within reach of persons standing on deck area 24.

The mechanism is operated by two persons standing on deck 24 at opposite sides of the pool, i.e. adjacent pool side surfaces 16 and 18. Each person grasps two handles 30 and 32 on his pole assembly, and then walks slowly along the deck surface in a left-to-right direction (FIG. 1). As the persons move along the deck surface the rollers roll on the pool floor; the associated stainer screen 27 scrapes along the floor surface to capture debris lying on the floor surface or suspended near the floor surface. When the mechanism reaches end wall 14 of the pool it is lifted out of the pool to carry away the particulates that were deposited on the strainer screen surface.

Each pole assembly 26 comprises two tubes 34 and 35 telescopically connected, one within the other, whereby the pole assembly length can be changed (adjusted) for more convenient usage in shallow or deep swimming pools by tall or short persons (with minimum stooping or stretching). A rotary clamp 36 may have a screw-type attachment on the upper end of each tube 35, whereby the clamp exerts an adjustable clamp fore on tube 34 to maintain the two tubes in selected positions of tube length adjustment.

The lower end portion of each tube 35 is curved and extended forwardly from the pole assembly axis. As seen in FIGS. 1, the term "forward" means rightwardly, i.e. in the direction taken by the mechanism during a debris-removal operating. The extreme forward end of the tube lower end is designated by numeral 39 in FIGS. 1 and 3 of the drawings.

Tube end 39 carries a forwardly-extending socket 38 that rotatably receives a circular cross-sectioned pin 40; each pin can swivel in socket 38, as designated by arrow 41 in FIG. 2, whereby the associated rollers 48 are enabled to maintain contact with the curved surface contour 22 at the juncture between floor surface 10 and the upstanding side wall 16 or 18. The rollers in each roller assembly are independently rotatable so they can rotate at different rates, if necessary to adapt to surface irregularities in the pool surface.

A pin 42 may be extended through the side wall of each socket 38 into an arcuate slot 43 in pin 40 to retain the pin in the associated socket. Slot 43 may have a specific arcuate length (around the pin 40 axis) so as to limit the rotational motion of pin 40 in accordance with roller adjustment requirements.

The construction of socket 38 is such that the transverse roller shaft 46 is located above the axis of tube end 39. As a result, the two rollers 48, 48 in each roller assembly can be fairly large, while at the same time the lower edge of tube end 39 can be very close to floor surface 10. By this arrangement the leading edge of strainer screen 27 is located at or very near to floor surface 10.

Figure 3:
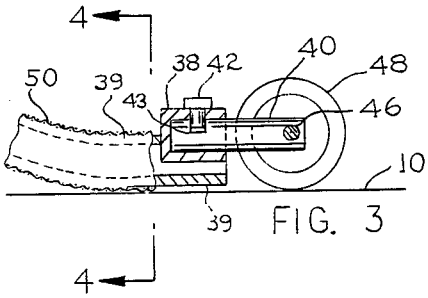
FIG. 3 is an enlarged fragmentary view of a part of the mechanism shown in FIG. 1
Figure 4:
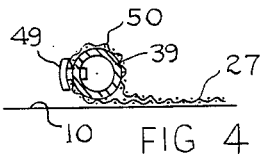
FIG. 4 is a fragmentary sectional view taken on line 4—4 in FIG. 3.

Strainer screen 27 can be attached to tubes 35 in various different ways. As shown in FIG. 4, the edge area of the cloth screen can be formed into a loop 50 and inserted onto the tube. One or more rivets 49, or their equivalent, can be used to fasten the looped portion of the screen onto the tube. As seen in FIGS. 3 and 4, the leading edge of the screen can be very close to pool surface 10 (due to the location of tube end 39 relative to rollers 48).

Tube end 39 extends forwardly in a generally horizontal direction, such that a significant length of tubing is in near adjacency to floor surface 10. Accordingly, the leading edge of screen 27 extends along the pool surface to minimize any gap that might exist between the screen and floor surface. Weights, not shown, may be attached to the screen near its leading edge to further minimize the screen-floor gap.

It is possible to further minimize the gap between the leading edge of screen 27 and the pool surface 10 by slightly tilting the pole assemblies rearwardly around the axis of roller shaft 46. As each pole assembly 26 is tilted back around shaft axis 46 (to the left in FIG. 1) the tube end 39 moves closer to floor surface 10, thereby causing the leading edge of screen 27 to scrape on the floor surface.

The swivel fit of each pin 40 in the associated socket 38 is advantageous in that it enables pole assembly 26 to be swung toward the pool side surface 16 and 18. As seen in FIG. 2, the pole assembly can be swung toward or away from the pool side surface without affecting the orientation of rollers 48 on the pool floor surface. The handles 30 and 32 can be easily reached and operated, according to the position most comfortable to the particular person using the mechanism.

It will be seen from FIG. 1 that roller assemblies 29 are located forwardly from the pole assembly axis. The pool owner is able to push the mechanism along, with minimal tendency for the mechanism to overturn. Handles 30 and 32 are also helpful; a push action on handle 30 and a restraining grasp on handle 32 tend to keep the pole assembly moving forward without overturnment of the mechanism.

The mechanism is believed to be a relatively low cost apparatus having the potential to greatly reduce the time necessary to remove debris from the floor surfaces of swimming pools.

I claim:

1. Mechanism for removing particulate debris from the floor surface of a swimming pool comprising two laterally-spaced pole assemblies adapted to assume upright positions in a swimming pool, a strainer screen extending between the pole assemblies, and roller means attached to the lower end of each pole assembly; said pole assemblies being of sufficient length that when the roller means are engaged with the pool floor surface the upper ends of the pole assemblies are within reach of persons standing on the swimming pool deck, whereby persons on the deck can move the pole assemblies across the pool so that the screen can capture particulates on or near the floor surface.

2. The mechanism of claim 1 wherein the lower end portion of each pole assembly extends forwardly from the pole assembly axis, whereby each roller means has an advanced position relative to the person moving the pole assembly.

3. The mechanism of claim 2 wherein the leading edge of the strainer screen is approximately at the same level as the lower edges of the roller means, whereby the screen leading edge is enabled to scrape the pool floor surface.

4. The mechanism of claim 1 wherein each roller means comprises two laterally-spaced rollers having a common axle.

5. The mechanism of claim 4 wherein the rollers in each roller means are undependently rotatable.

6. The mechanism of claim 1 wherein the lower end of each pole assembly comprises a forwardly-extending socket; each roller means comprising a pin rotatably mounted in the associated socket for rotation around the socket axis, a shaft extending transverse to the pin, and rollers rotatably mounted on said shaft.

7. The mechanism of claim 6 and further comprising means for limiting the rotary movement of each pin in the associated socket.

8. The mechanism of claim 7 wherein each roller shaft is located above the lower end of the associated pole assembly.

9. The mechanism of claim 1 wherein each roller means is adjustably attached to the associated pole assembly for swinging movement around an essentially horizontal axis extending forwardly from the associated pole means, whereby said roller means is enabled to maintain contact with inclined pool surface areas at the floor-side surface juncture.

10. The mechanism of claim 1 wherein each pole assembly is capable of transverse swinging motion around its connection point with the associated roller means, whereby each pole assembly is within reach of persons standing on the pool deck without disturbing the roller means-pool floor relationship.

11. The mechanism of claim 1 wherein each pole assembly is adjustable in the direction of its length.

12. The mechanism of claim 1 wherein each pole assembly has an adjustable length.

13. The mechanism of claim 1 wherein each pole assembly comprises at least two telescopically-connected tubes.

14. The mechanism of claim 1, and further comprising an upper handle and a lower handle extending from each pole assembly for manual gripment by persons standing on the pool deck.

* * * * *